United States Patent [19]

Simmons

[11] Patent Number: 5,011,424

[45] Date of Patent: Apr. 30, 1991

[54] LATCH MECHANISM FOR ELECTRICAL CONNECTOR

[75] Inventor: Randy G. Simmons, Clemmons, N.C.

[73] Assignee: AMP Incorporated, Harrisburg, Pa.

[21] Appl. No.: 431,049

[22] Filed: Nov. 1, 1989

[51] Int. Cl.[5] ..... H01R 13/627

[52] U.S. Cl. ..... 439/352; 439/357

[58] Field of Search ..... 439/345, 350, 351, 352, 439/355, 357, 358, 372, 607, 608, 609, 610

[56] References Cited

U.S. PATENT DOCUMENTS

| | | | |
|---|---|---|---|
| Re. 32,864 | 2/1989 | Ezure | 439/152 |
| 4,838,808 | 6/1989 | Fujiura | 439/357 |
| 4,915,642 | 4/1990 | Lin et al. | 439/357 X |
| 4,919,627 | 4/1990 | Cable | 439/372 X |

FOREIGN PATENT DOCUMENTS

| | | | |
|---|---|---|---|
| 60-146509 | 9/1960 | Japan . | |
| 1048230 | 11/1966 | United Kingdom | 439/357 |

*Primary Examiner*—Neil Abrams
*Assistant Examiner*—Khiem Nguyen
*Attorney, Agent, or Firm*—Eric J. Groen; Bruce J. Wolstoncroft

[57] ABSTRACT

An electrical connector is disclosed which comprises an inner shielded body having two hinges stamped from the sidewalls thereof. Spring latching arms are rotatably connected to the hinges and comprise forward portions which include latching surfaces which latch the connector to a complementary connector. The latching arms further comprise, rearward of the hinge, surfaces which converge from front to rear. The outer housing includes an internal camming surface adjacent to the converging surfaces on the spring arms. The housing is axially movable relative to the inner shielded body, thereby to rotate the latch arms and unlatch the connector.

5 Claims, 3 Drawing Sheets

LATCH MECHANISM FOR ELECTRICAL CONNECTOR

BACKGROUND OF THE INVENTION

1. Field of the Invention

The subject invention relates to an improved latching mechanism for electrical connectors.

2. Description of the Prior Art

There is shown in U.S. Pat. No. 4,941,849 a shielded electrical connector having a latch mechanism comprising an outer insulating cover which is profiled to overlap and encompass an inner shielded connector sub-assembly. The outer housing of the electrical connector has hinged thereto, a pair of spring arms which are spring loaded into a position where the forward section of the spring arm is proximate to the sidewalls of the shielded sub-assembly. The forward section of the spring arms includes a rearwardly directed latching face which is latchable to a complementary latching structure in a complementary connector.

Rearwardly the spring hinge, are actuator arms sections which are integral with the spring members. The outer insulating housing member includes windows along the sidewalls such that when the outer housing overlaps the inner shielded sub-assembly, the actuator arms of the inner spring members extend outwardly through the windows of the outer housing members. To unlatch the connector from a mated connector, the spring arms are compressed towards the shielded inner sub-assembly causing the spring arms to rotate about their hinged position thereby moving the foward section, including the rearwardly facing latch, outwardly to a position where the connector assembly is adequate for its intended purpose, a disadvantage of this connector design is that two separate movements must be made prior to unlatching the connector. In other words, the latch arms must be compressed, and the connector housing must be pulled rearwardly to unlatch the connector assembly.

SUMMARY OF THE INVENTION

It is an object of the invention then to design an electrical connector where only one movement, for example, a pulling on the connector housing along disengages the connector from the mating connector.

The object of the invention was accomplished by designing an electrical connector of the type having an inner body section and an outer housing section, the inner body section having two latch arms operatively hinged to the connector. The connector has forward of its hinge, a latch arm having latching surfaces at its forward end which latch the connector to a complementary connector. The connector has rearward of the hinge, rotatable actuation arms. The connector is characterized in that the rotatable actuation arms including on the ends, actuator sections having forwardly directed surface, while the housing includes a rearwardly facing camming surface disposed proximate to the forwardly facing surface, and in that the housing is axially moveable relative to the inner body causing the camming surface to rotate the latch arms about the hinge, thereby unlatching the connector from the complementary connector.

BRIEF DESCRIPTION OF THE DRAWINGS

FIG. 3 is a view similar to that of FIG. 2 showing the housing pulled back to actuate the latching mechanism.

DETAILED DESCRIPTION OF THE PREFERRED EMBODIMENT

Figure 1:
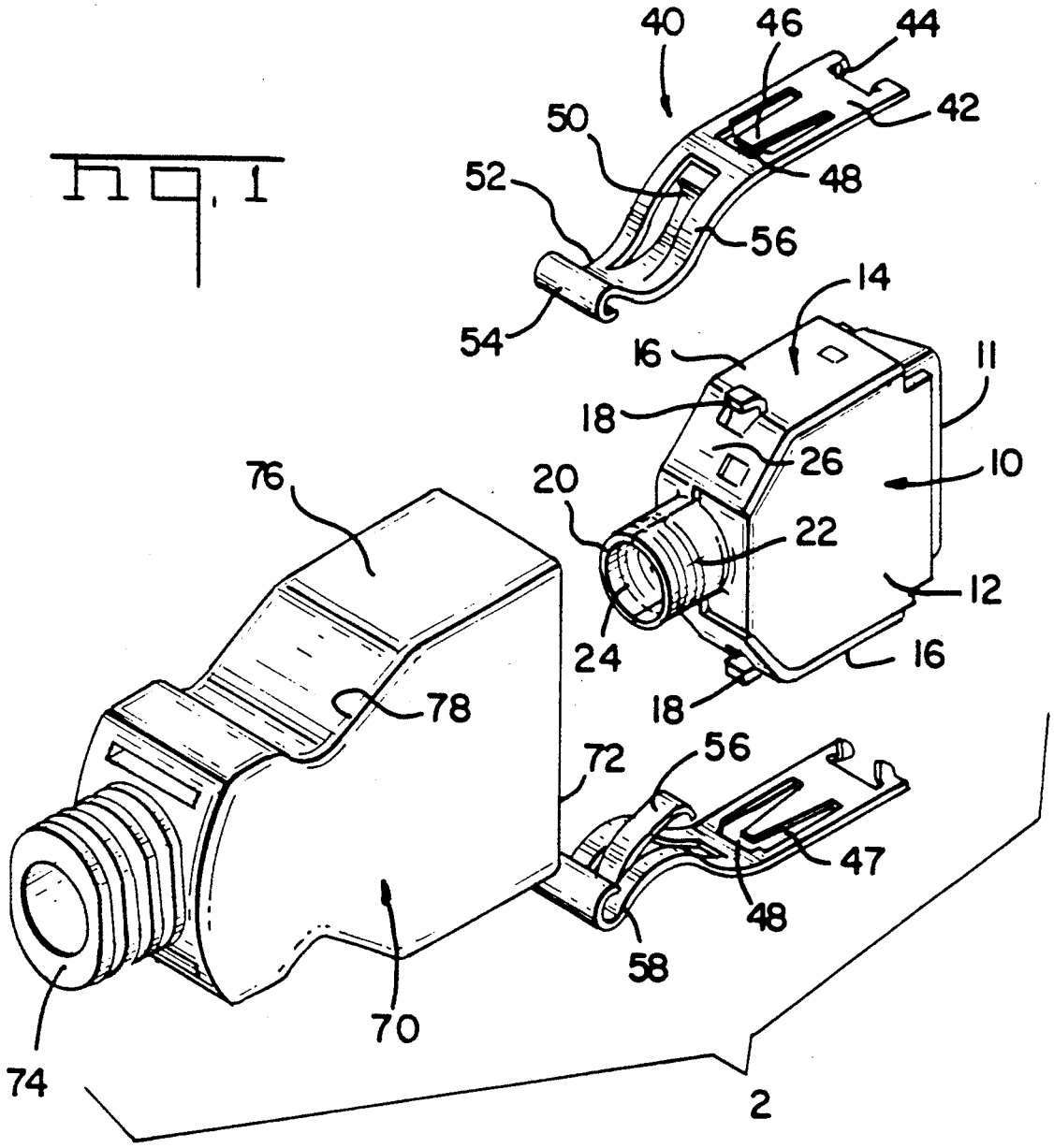
FIG. 1 is an isometric view showing the connector assembly exploded apart.

With reference first to FIG. 1, the connector assembly 2 is shown as generally comprising a shielded sub-assembly 10, side spring latch arms 40 and an outer housing comprised of insulating material shown generally as 70. The inner shielded member 10 comprises an upper shielding cover 14 and a lower shielding cover 12, the shielding members being cooperatively profiled to encapsulated an insulating housing having a plurality of electrical terminals of the type shown in U.S. Pat. No. 4,941,849, incorporated herein by reference. The upper shield member 14 comprises sidewalls 16 having stamped out hook section 18 therefrom. The sidewalls 12 and 14 have rearwardly directed surfaces 26 which diverge from the front to the rear. The upper 14 and lower 12 shield members also have upper and lower 20, 22 respectively semicircular openings which cooperatively form an opening for a shielded cable therethrough. Finally, the shield member 10 includes a front mating shield shroud 11 cooperatively profiled to mate with the shielding shroud of a complementary connector.

The side latching members 44 extending from the free end thereof. Within the spring arm 42 is a stamped out, U shaped opening 47 thereby defining a resilient arm 46, and a hinge receiving opening 48. The latching member 40 further comprises an actuator section 56 comprising a biasing spring 50 stamped therefrom, an arcuately shaped surface 52 and a folded over end section 54. The outer insulating housing 70 comprises a front mating section 72 and a rear cable receiving section 74.

Figure 2:
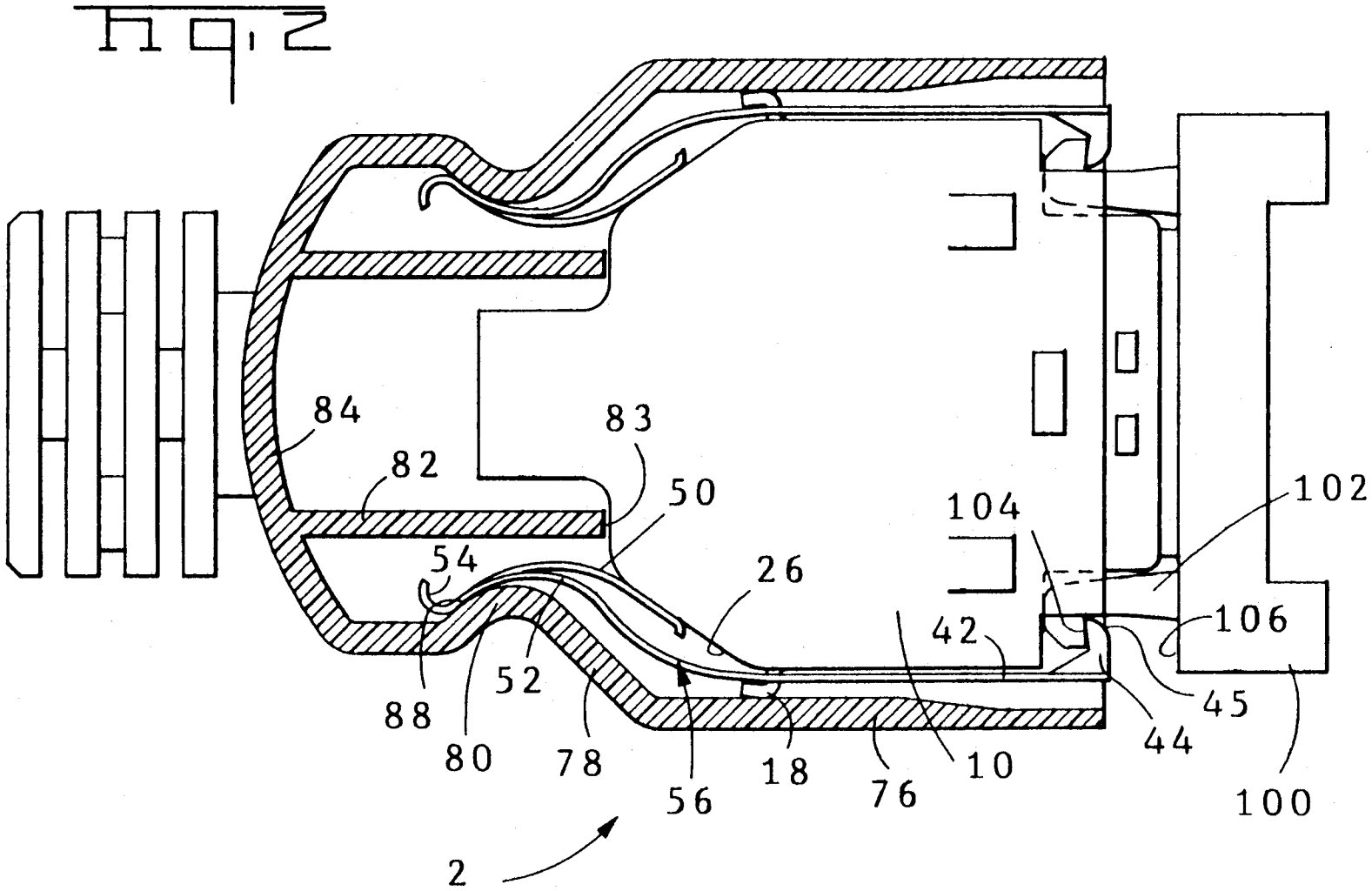
FIG. 2 is an upper plan view of the assembled connector partially broken away to show the inner structure of the connector assembly.
Figure 1:
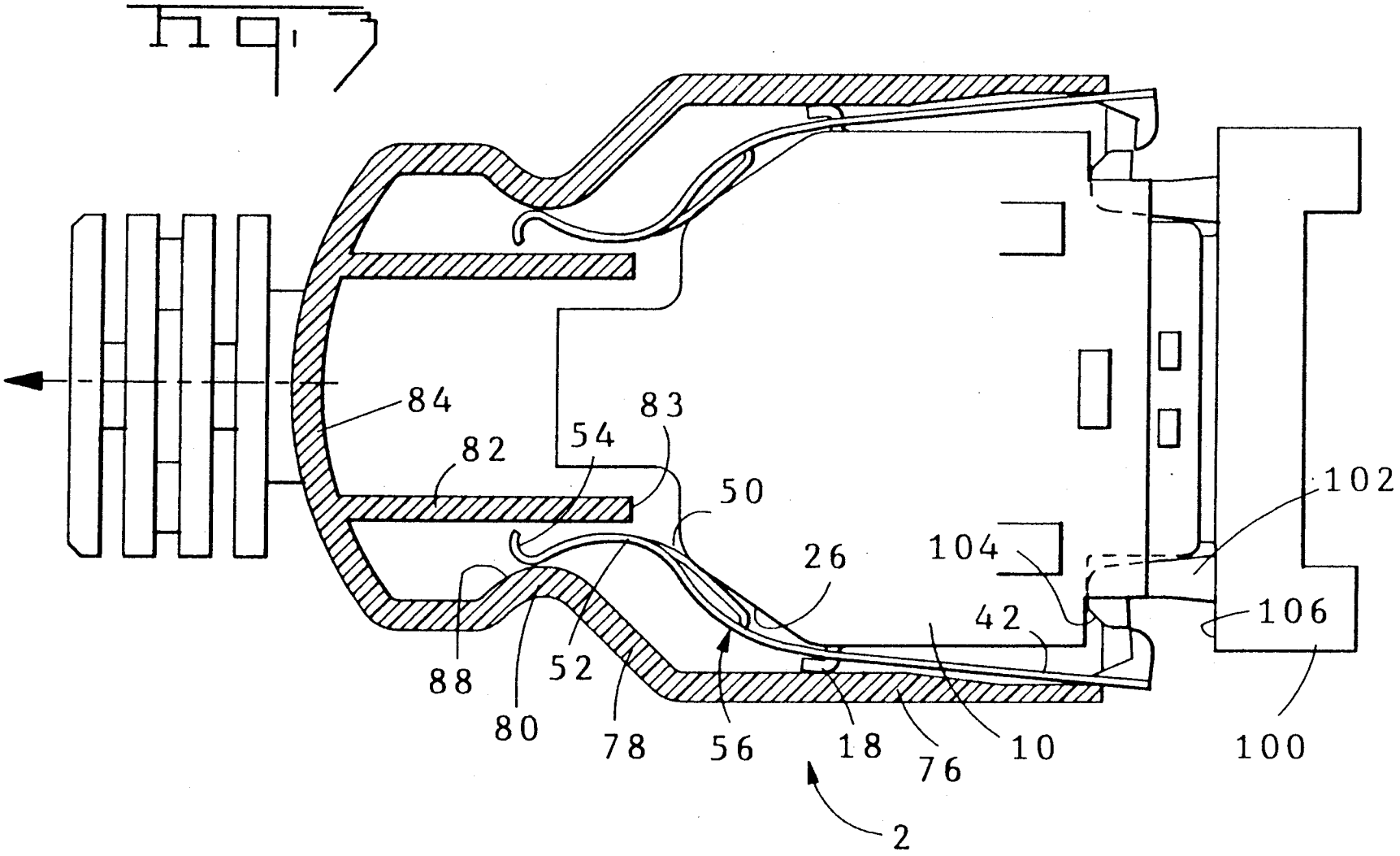

With respect now to FIG. 2, the housing is shown as including a sidewall 76, which is continuous with a wall section 78 which converges from front to rear, the wall 78 being continuous with an arcuately shaped wall section 80. At the rear of the connector are stop ribs 82 extending forwardly from the rear face 84 of the connector housing.

To assemble the connector assembly, the upper 14 and lower 12 shield members are assembled over a connector housing to encapsulate the insulating housing to complete an assembly as shown in FIG. 1. The latch members 40 are then assembled over the hook members 18 by pressing the latch members 40 over the hook section 18 deflecting the spring arms 46 such that the hook sections 18 resides in the openings 48. The housing is then assembled over the shielded sub-assembly 10 and the latch members 40, such that the arcuate shape portion of the latch arms 52 overlaps the arcuately shaped section 80 of the housing member as shown in FIG. 2. As shown in FIG. 2, the spring section 50 is biased against surface 26 of the inner shielded sub-assembly 10, while the forwardly directed surface 58 (FIG. 1) of the latch member 40 is spring biased against the surface 88 of the arcuate wall section 80. In its initial state, the housing member 70, is held in its forward position as shown in FIG. 2 and is held to the inner shielded sub-assembly 10 due to the spring forces between the spring arm 50 and the spring contact surface 58.

With reference still to FIG. 2, the electrical connector assembly 2 is interconnectable to a mating complementary connector 100 having latching arms 102 extending from a front face 106, the latching arms 102 having lead in surfaces 104 and rearwardly facing latch surfaces. When it is desired to interconnect the connector assembly 2 to complementary connector 100, the outer housing 70 can be grasped and forced forwardly such that the lead in surfaces 45 and 104 cause the outward spring biasing of the latch arms 42 until the latching surfaces are in a latched condition as shown in FIG. 2. When the connector is to be unmated, the outer housing 70 is grasped and pulled rearwardly. The housing 70 will move longitudinally relative to the inner shielded assembly 10 causing the arcuate surface 80 to lift the rear section 58 of the spring arm thereby causing the forward spring arm section 42 to rotate about the hinge 18 causing the forward latch member 44 to become disengaged from the complementary latch 102 of the mating connector 100.

The invention was described with relation to the preferred embodiment only and is therefore not intended to limit the scope of the claims which follow.

I claim:

1. An electrical connector having an inner body section and an outer housing section, the inner body section having two latch arms operatively hinged to hinges provided on side walls thereof, and having forward of the hinges, latch arms having latching surfaces at forward ends which latch the connector to a complementary connector, the connector having rearward of the hinges, rotatable actuation arms; the connector being characterized in that:

the latch arms are stamped from a material having resilient characteristics, hinge receiving openings extend through the latch arms, the hinge receiving openings being dimensioned to received respective hinges therein, the rotatable actuation arms are provided on the latch arms and extend from the hinge receiving openings in a direction opposed to the latching surfaces, the rotatable actuation arms including on ends thereof, actuator sections having forwardly directed surfaces, while the housing include rearwardly facing camming surfaces disposed proximate to the forwardly facing surfaces, and in that the housing is axially movable relative to the inner body causing the camming surfaces to rotate the latch arms about the hinges, thereby unlatching the connector from the complementary connector.

2. The electrical connector of claim 1 characterized in that the forwardly facing surfaces on the actuation sections comprise arcuately shaped surfaces.

3. The electrical connector of claim 2 characterized in that the camming surface is defined by an arcuately shaped inner housing wall which lies proximate to the arcuately shaped surfaces on the actuator sections.

4. The electrical connector of claim 3 characterized in that the actuation arms include biasing springs stamped therefrom and are biased against a rearwardly directed surface of the inner body, causing a forward component of force on the inner body.

5. The electrical connector of claim 4 characterized in that the forwardly directed surface of the actuator sections are spring loaded against the rearwardly directed surfaces on the arcuately shaped inner housing wall, the cooperation between the actuator sections and the arcuately shaped inner housing wall effectively retaining the housing to the inner body.

* * * * *